US007506754B2

(12) United States Patent
Segovia, Jr. et al.

(10) Patent No.: US 7,506,754 B2
(45) Date of Patent: Mar. 24, 2009

(54) BABY BOTTLE/BEVERAGE DEVICE

(75) Inventors: Eugenio Segovia, Jr., Bellville, TX (US); Kurt S. Myers, Houston, TX (US)

(73) Assignee: Simple Innovations, L.L.C., Bellville, TX (US)

( * ) Notice: Subject to any disclaimer, the term of this patent is extended or adjusted under 35 U.S.C. 154(b) by 419 days.

(21) Appl. No.: 11/230,044

(22) Filed: Sep. 19, 2005

(65) Prior Publication Data

US 2006/0011497 A1 Jan. 19, 2006

Related U.S. Application Data

(63) Continuation-in-part of application No. 10/652,900, filed on Aug. 30, 2003, now Pat. No. 6,945,394, which is a continuation-in-part of application No. 09/757,756, filed on Jan. 10, 2001, now Pat. No. 6,612,428.

(60) Provisional application No. 60/212,860, filed on Jun. 20, 2000.

(51) Int. Cl.
*B65D 25/08* (2006.01)

(52) U.S. Cl. ..... 206/219; 215/11.1; 215/11.3; 215/DIG. 8

(58) Field of Classification Search ..... 215/6, 215/11.1, 11.3, 11.4, 11.6, DIG. 8; 426/117; 206/219, 222

See application file for complete search history.

(56) References Cited

U.S. PATENT DOCUMENTS

| | | | | |
|---|---|---|---|---|
| 2,885,104 | A | | 5/1959 | Greenspan |
| 4,411,300 | A | * | 10/1983 | Rico ..... 383/33 |
| 4,664,288 | A | | 5/1987 | Pereira et al. |
| 4,678,092 | A | | 7/1987 | Rane |
| 4,700,856 | A | | 10/1987 | Campbell et al. |
| 4,821,913 | A | | 4/1989 | Hidding |
| 5,000,314 | A | | 3/1991 | Fuller et al. |
| 5,005,733 | A | * | 4/1991 | Stoody ..... 222/105 |
| 5,476,322 | A | * | 12/1995 | Stoody ..... 383/33 |
| 5,758,787 | A | | 6/1998 | Sheu |
| 5,996,833 | A | | 12/1999 | Lencioni et al. |
| 6,089,389 | A | | 7/2000 | Sharon et al. |
| 6,612,428 | B1 | | 9/2003 | Segovia et al. |
| 6,669,013 | B1 | | 12/2003 | Villanueva |
| 6,945,384 | B2 | | 9/2005 | Segovia et al. |

* cited by examiner

*Primary Examiner*—David T Fidei
(74) *Attorney, Agent, or Firm*—Kurt S. Myers

(57) ABSTRACT

The present invention is directed to a contemporary beverage dispenser, especially suited as a baby bottle, comprising a solid connector that has an upper portion and a lower portion and a plastic bag connected to the lower portion. The uniqueness of the combination of the connector and bag is that the connector is designed to fit on the lip of a conventional baby bottle with the bag in the bottle or is used without a bottle. When used without a bottle, a compression ring is used to connect a head, such as a nipple, to the beverage dispenser of the present invention.

7 Claims, 8 Drawing Sheets

BABY BOTTLE/BEVERAGE DEVICE

RELATED APPLICATIONS

This application is a continuation-in-part of U.S. Ser. No. 10/652,900, filed Aug. 30, 2003, entitled "Beverage Device", now U.S. Pat. No. 6,945,394, which in turn is based on U.S. Ser. No. 09/757,756, filed Jan. 10, 2001, entitled Disposable/Recyclable Beverage Device", now U.S. Pat. No. 6,612,428, which in turn is based on provisional application Ser. No. 60/212,860, filed Jun. 20, 2000, entitled "Disposable Baby Bottle", which are incorporated herein by reference.

FIELD OF THE INVENTION

The present invention is directed to a contemporary baby bottle and beverage device. More specifically, the present invention is directed to a connector that is connected to and secures a two chamber plastic bag. The connector of the present invention is designed so that the connector fits on the lip of a conventional baby bottle or the connector is connected by a compression ring to a nipple or head to be used without a bottle.

BACKGROUND OF THE INVENTION

The first baby bottle designed by Applicants was a disposable/recyclable beverage device characterized by a connector that had a circumferential groove around the outer surface of the connector as described in U.S. Pat. No. 6,612,428, issued Sep. 2, 2003. To the connector, a two compartment bag was connected to the neck of the connector. To complete the beverage device, a cap that had expansion fingers snapped into the circumferential groove of the connector. The cap provided an opening for the baby or person to drink the mixed liquid in the bag, after breaking the seal of the bag forming the two compartments.

The second baby bottle designed by Applicants was a disposable/recyclable beverage device characterized by a connector that had threads around the outer surface of the connector as described in U.S. Pat. No. 6,945,394, issued Sep. 20, 2005. To the connector, a two compartment bag was connected to the neck of the connector. To complete the beverage device, a cap that had threads meshed with the threads around the outer surface of the connector. The cap provided an opening for the baby or person to drink the mixed liquid in the bag, after breaking the seal of the bag forming the two compartments.

In the present invention, the cap as illustrated in the first two designs is eliminated and a new connector is the uniqueness of the invention. This invention is therefore a beverage device that is cheaper and may be employed in at least two different manners; the first is with a conventional baby bottle, and the second is with an inexpensive compression ring. Hurricane Katrina was the inspiration for the compression ring embodiment.

SUMMARY OF THE INVENTION

The present invention is directed to a contemporary beverage dispenser, especially suited as a baby bottle, comprising a solid connector and a two compartment bag connected to the lower portion of the connector that has an upper portion and a lower portion. The uniqueness of the combination of the connector and bag, the beverage dispenser of the present invention, is that it may be used with a conventional baby bottle or without a bottle. When used without a bottle, a compression ring connects a cap, such as a nipple, to the beverage dispenser of the present invention.

DESCRIPTION OF THE PRESENT INVENTION

The present invention is directed to a beverage dispenser that includes a connector and a plastic bag that has two compartments, one for holding solid and one for holding liquid. A sealed seam which is easily rupturable separates the two compartments. The solid in one compartment may be selected from many beverage concentrates such as infant formula or fruit drinks and the liquid is preferably water. The beverage dispenser of the present invention preferably has a seal at the top, a filmed sheet with a tab. The connector of the beverage dispenser of the present invention is much different than the connectors disclosed and claimed in the US Patents referred to above. The connector of the present invention is a solid piece, preferably injection molded from an injection molding plastic, such as polyethylene or polypropylene. While the connector is a solid piece it is characterized as having an upper portion and a lower portion. The upper portion is shaped as a washer; meaning a flat disk or ring used to make a seat and serve as a seal (which will be described in more detail herein below). The lower portion has an outer surface that is of lesser diameter than the washer upper portion however is several magnitudes greater in height than the ring of the washer portion. The washer portion and the lower portion has substantially the same diameter opening passing through both portions. The two compartment bag is connected to the lower portion of the beverage dispenser. The details of the embodiments of the present invention will be disclosed with reference to the drawings.

Figure 1:
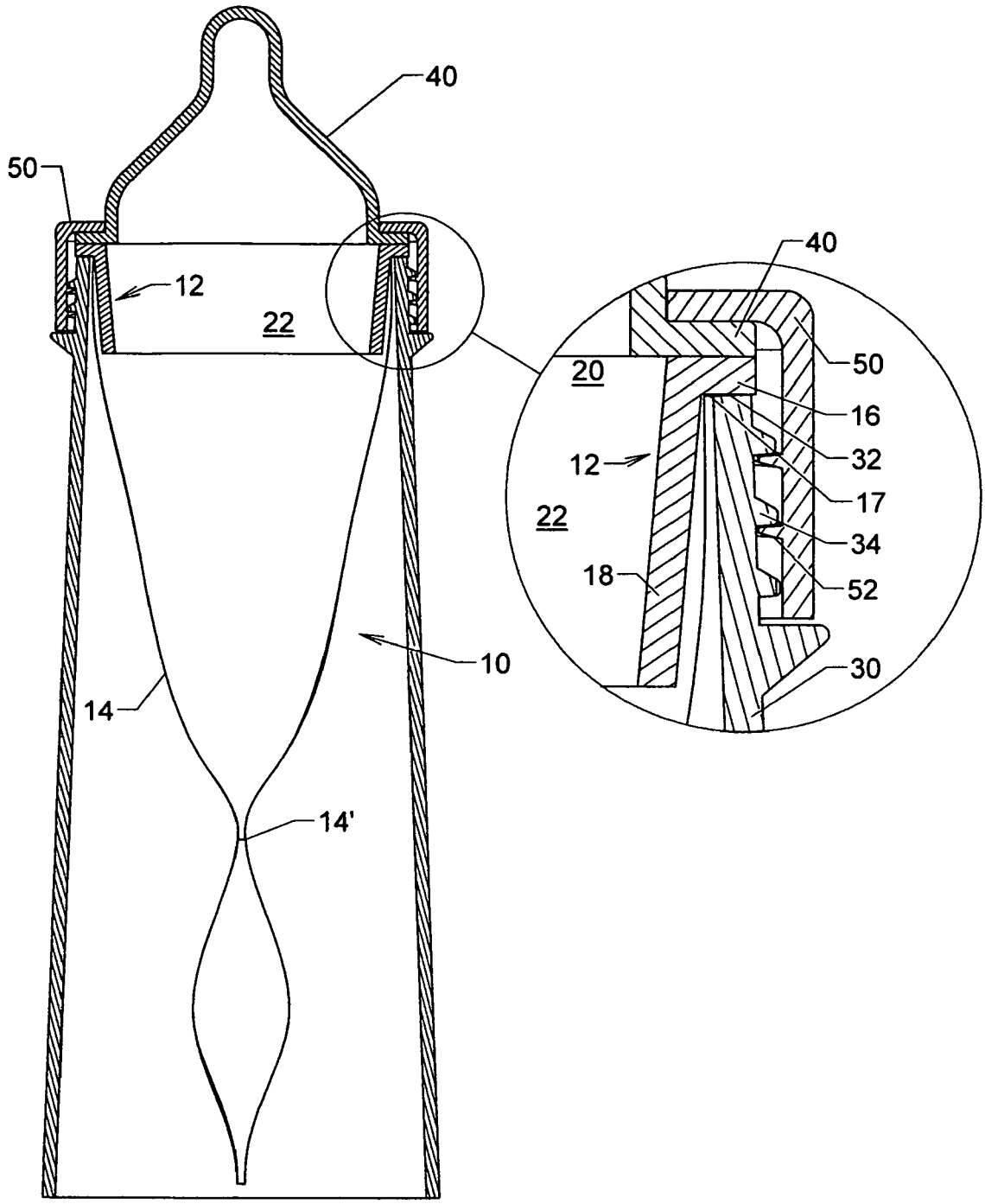
FIG. 1 is a cross-sectional view of the beverage dispenser of the present invention assembled in a conventional baby bottle, with a detailed partial view.

Referring to FIG. 1, the beverage dispenser 10, the uniqueness of the present invention, comprises a connector 12 and a bag 14. Connector 12 has an upper portion 16 and a lower portion 18. The upper portion 16 is shaped as a washer; more specifically a flat, thin ring or cylinder with an opening 20 (shown most clearly in the detailed view of FIG. 1) in the center thereof. The lower portion 18 of connector 12 is shown as a hollow cylinder. This lower portion cylinder 18 illustrated in FIG. 1 may have a taper (exaggerated in the figures so that the taper may be seen). The outer diameter of lower portion 18 is less than the outer diameter of the washer, upper portion 16.

An opening 22 extends through the lower portion 18 having a diameter essentially the same as the opening 20 in upper portion 16. The reason for the difference in diameters in upper portion 16 and lower portion 18 is illustrated in FIG. 1 when the beverage dispenser 10 of the present invention is used with an ordinary baby bottle 30.

The baby bottle 30 has a lip 32 terminating at the top of the bottle. Also the bottle 30 has threads 34 on the outer surface at the top of the bottle 30. For the baby bottle to be complete, a cap including a nipple 40 and a screw cap 50 is employed. The cap 50 has threads 52 that mesh with the threads 34 on the bottle 30 to compress a nipple 40 to the lip 32 of the bottle when used in a conventional manner. In places where water is safe, clean and available, infant formula is purchased in bulk and mixed with water to fill the bottle 30. However, in places where water is unsafe and contaminated or simply unavailable or inconvenient, the conventional mixing of bulk solids, such as baby formula is not possible. It is the object of the present invention to provide a beverage dispenser that assures safe, sterile water and maintains the bulk solid separate from the liquid until ready for use to assure that a safe product is available to the user.

Thus, the beverage dispenser 10 of the present invention is placed inside the bottle 30 in this embodiment. The diameter of the lower portion 18 of the connector 12 is less than the inner diameter of bottle 30, whereas the diameter of the upper portion 16 of the connector 12 is essentially the same as the outer diameter of the lip 32 of bottle 30. As shown in the detailed view of FIG. 1, the lower surface 17 of the upper portion 16 of the connector 12 rests on the lip 32 of bottle 30. A cap including nipple 40 is placed over the beverage dispenser 10 and the screw cap 50 when screwed onto bottle 30 compresses both the nipple 40 and the upper portion 16 of connector 12 to the lip 32 of bottle 30.

Figure 2:
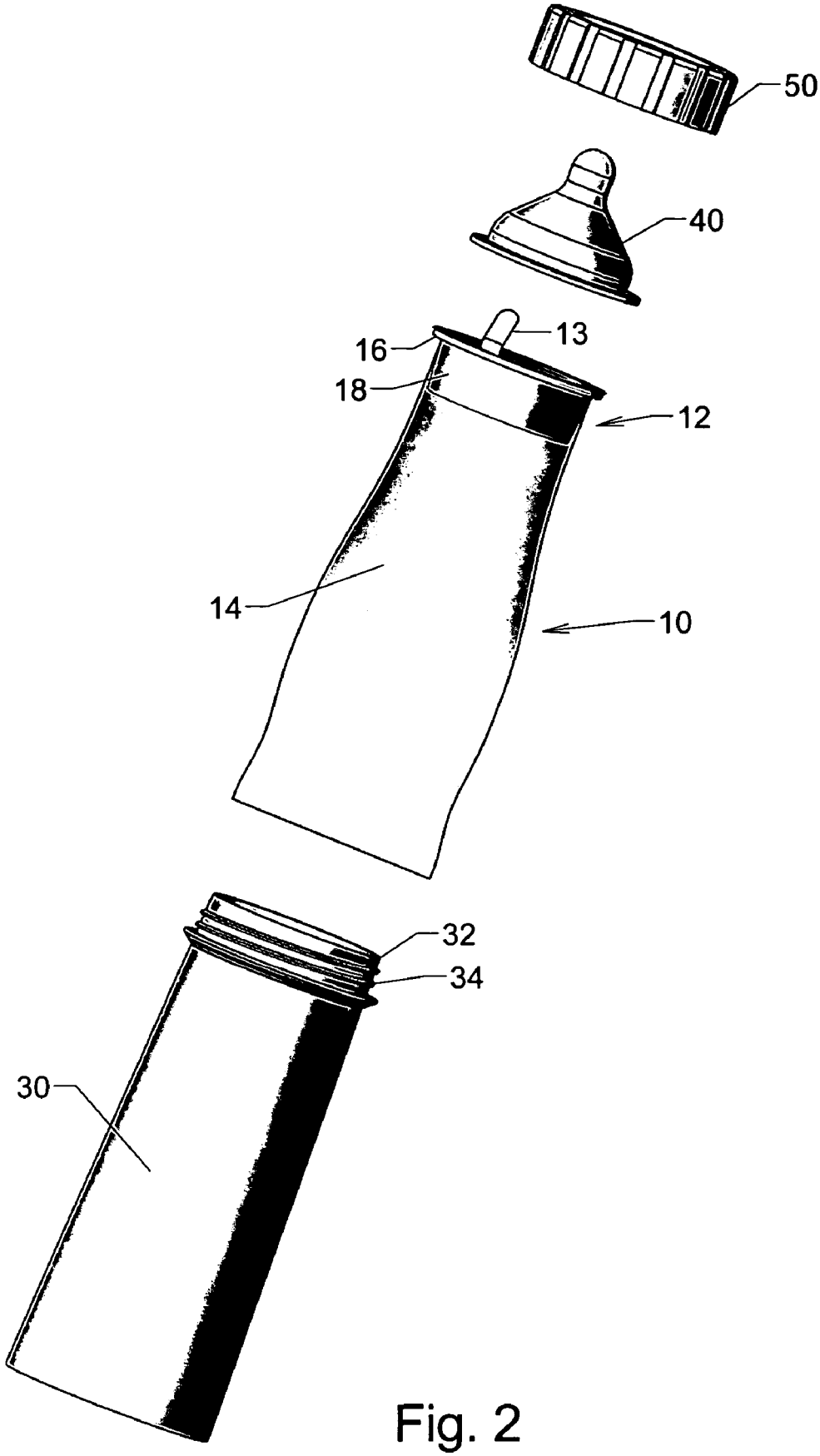
FIG. 2 is an exploded front view of the beverage dispenser of the present invention with a conventional baby bottle.
Figure 3:
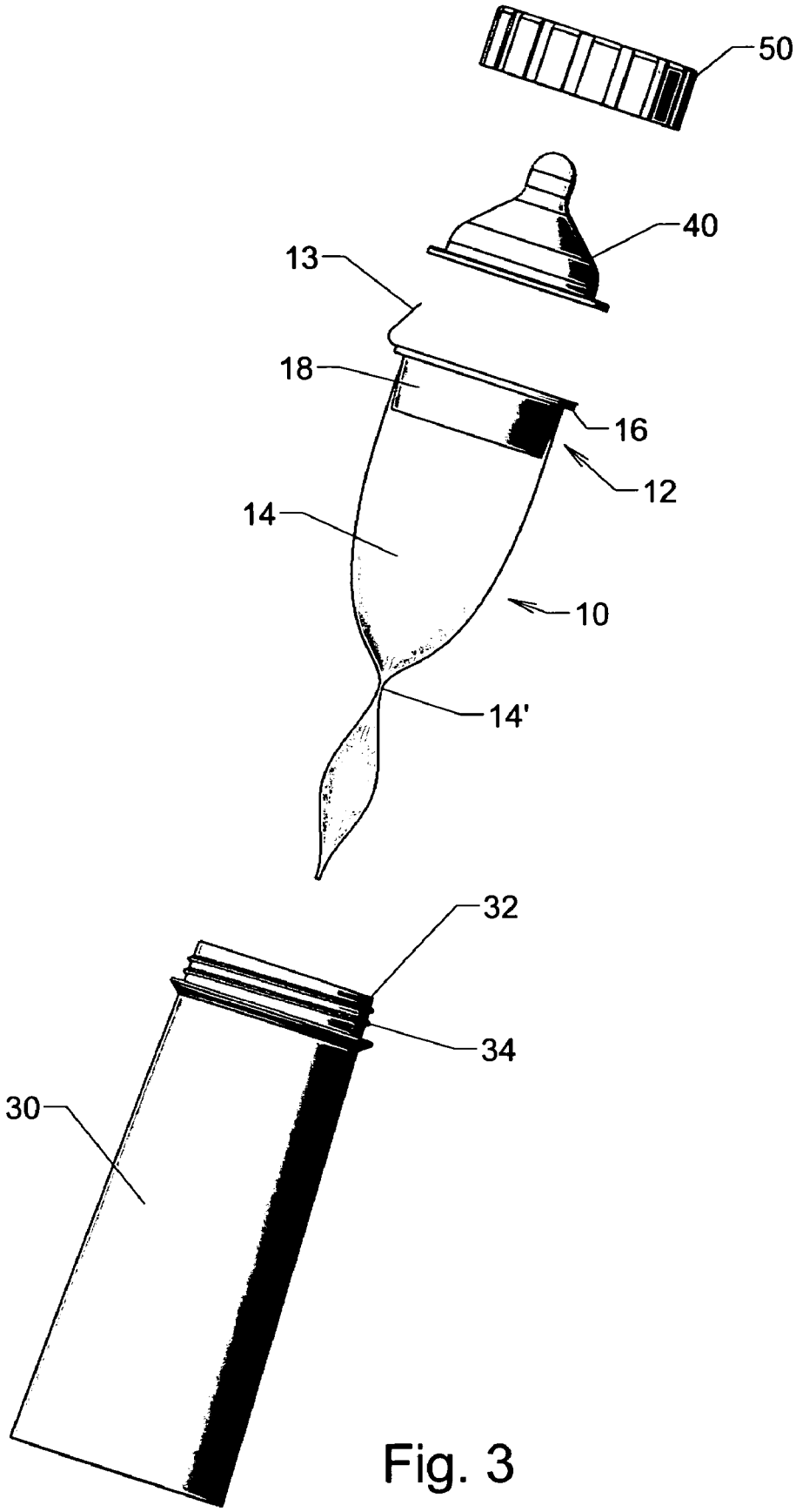
FIG. 3 is an exploded side view of the beverage dispenser of the present invention with a conventional baby bottle.

Referring to FIG. 2 and FIG. 3, the beverage dispenser 10 of the present invention is sealed at the top with a filmed sheet with a tab 13. How the bag 14 is filled and sealed to the connector 12 or the seal 14' is made to form the two compartments depends on the equipment used in those operation. For example, a bag having a single compartment may be sealed to the lower portion 18 of connector 12 and placed on a conveyer with the upper portion 16 positioned at the top, filling the bag from the top through the openings 20 and 22 in the connector 12 a first material, preferably the solid, such as baby formula, is added to the bag 14. The conveyer may then take the partially filled bag to a heat sealing device for producing seal 14' making the second compartment and then filling the upper compartment with sterile water. The beverage dispenser 10 of the present invention is then sealed at the top with a plastic sheet with a tab 13. Again emphasizing that the specific equipment used will determine the operation, the seal 14' forming the two compartments may precede the filling and the filling may be done by filling one compartment and then turning the beverage dispenser over to fill the other compartment.

Figure 4:
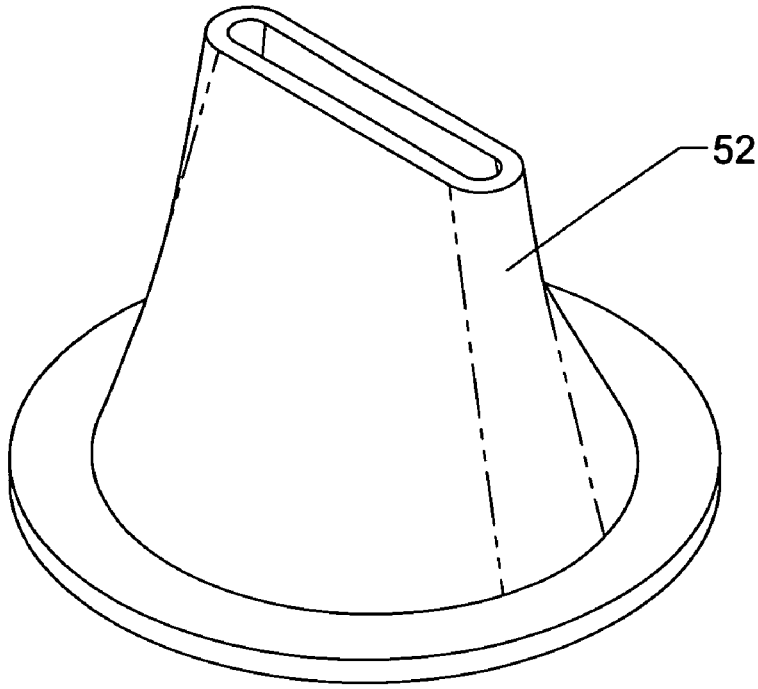
FIG. 4 is an isometric view of a cap that replaces the nipple.
Figure 5:
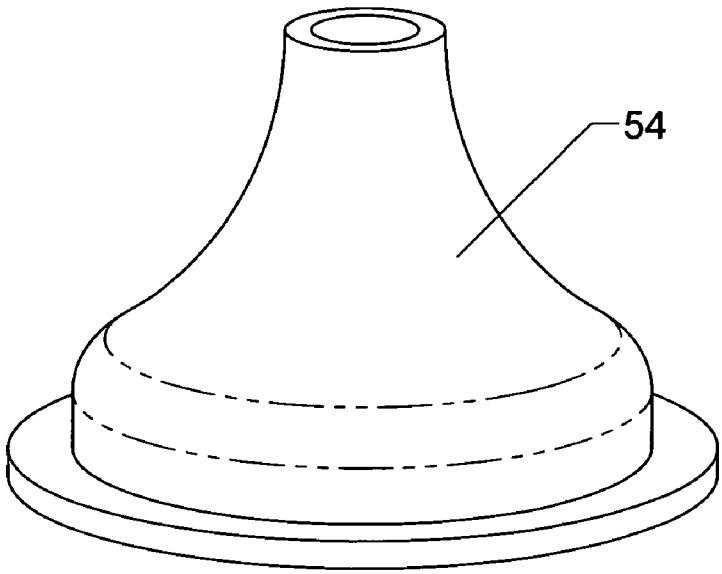
FIG. 5 is an isometric view of a cap of another design.

Referring now to FIG. 4 and FIG. 5, caps other than a nipple are illustrated showing that caps having any shaped opening may be used. In FIG. 4 an infant cap 52 is shown. A cap 54 is illustrated in FIG. 5 that may be used with a straw.

Figure 6:
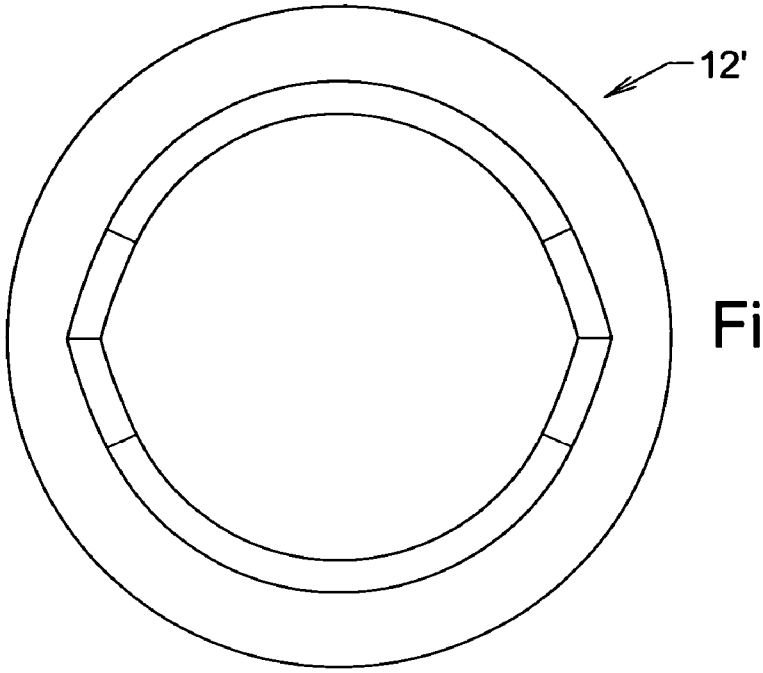
FIG. 6, FIG. 7 and FIG. 8 is a top, side and bottom view respectively, of another embodiment of the shape of the connector of the present invention.
Figure 7:
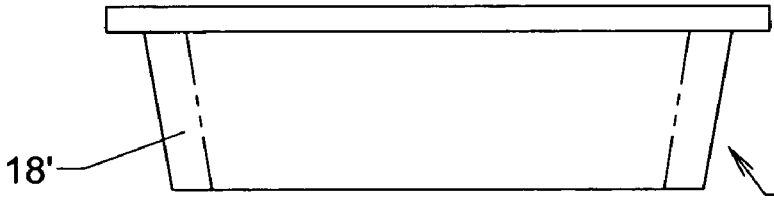
Figure 8:
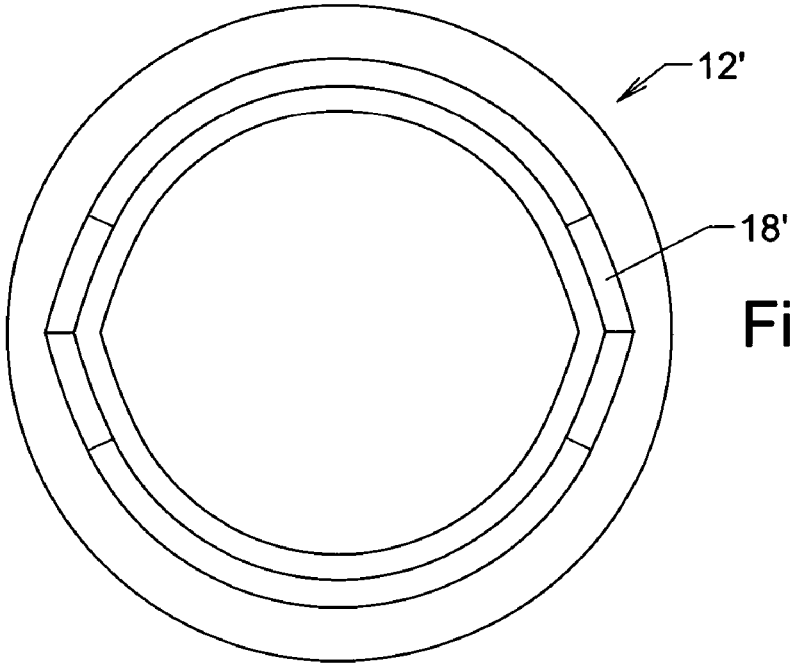
Figure 9:
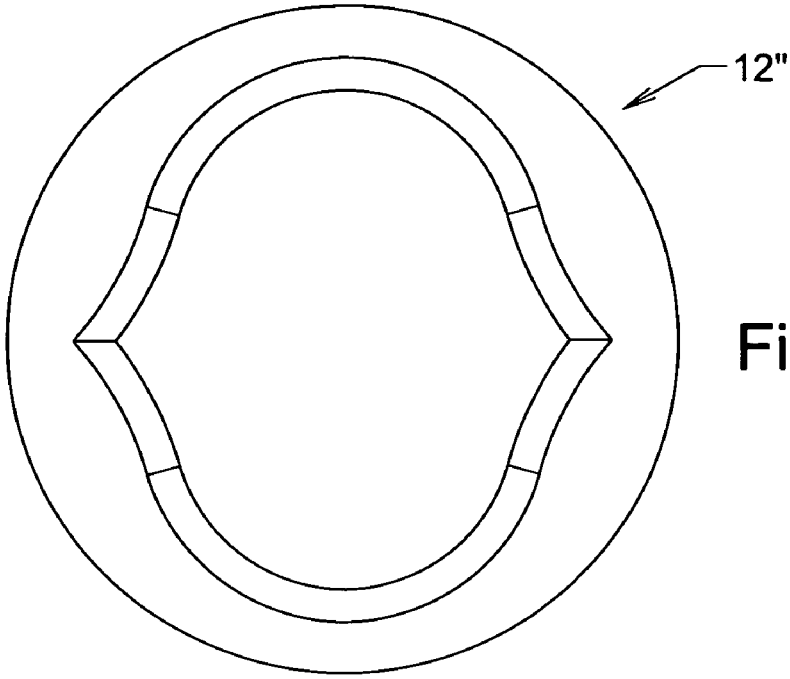
FIG. 9, FIG. 10 and FIG. 11 is a top, side and bottom view respectively, of still another embodiment of the shape of the connector of the present invention.
Figure 10:
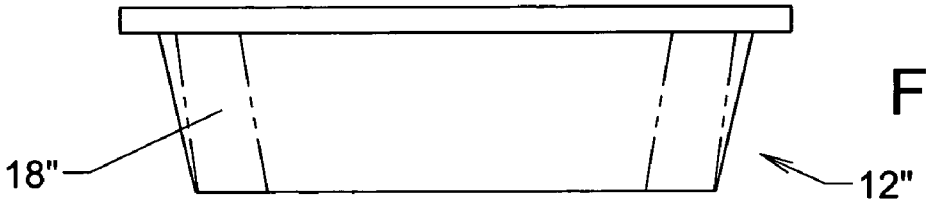
Figure 11:
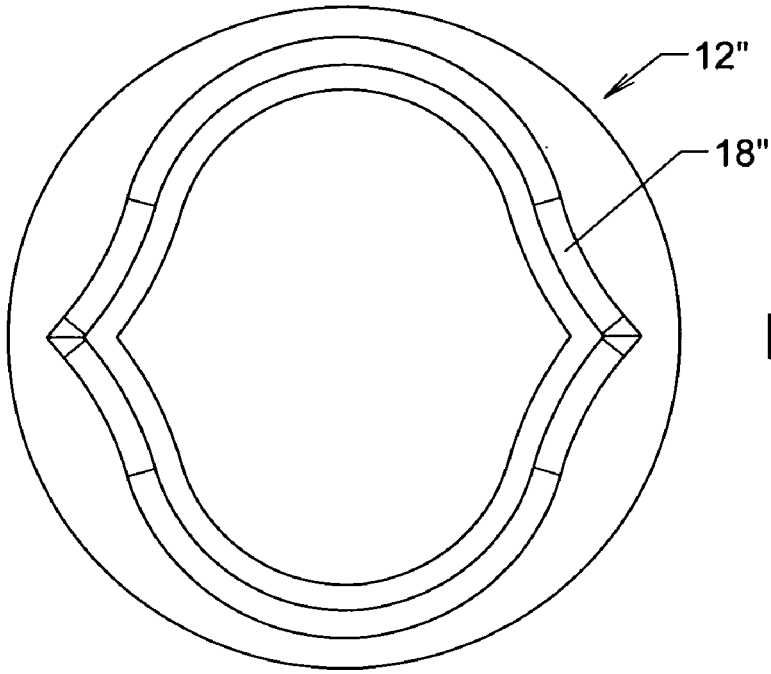

The shape of lower portion 18 of connector 12 is preferably a hollow cylinder as illustrated in FIG. 1. No matter what the shape of the lower portion of connector 12 is, the dimensional constraints are the same as the hollow cylinder of FIG. 1. FIGS. 6-8 illustrate that the shape of lower portion 18' of connector 12' may be a hollow elliptical shape. FIGS. 9-11 illustrate that the shape of lower portion 18" of connector 12" may be still a different shape. The desired shape will depend on the equipment used, which is not part of this invention, to connect the bag 14 to the lower portion 18 of connector 12.

Figure 12:
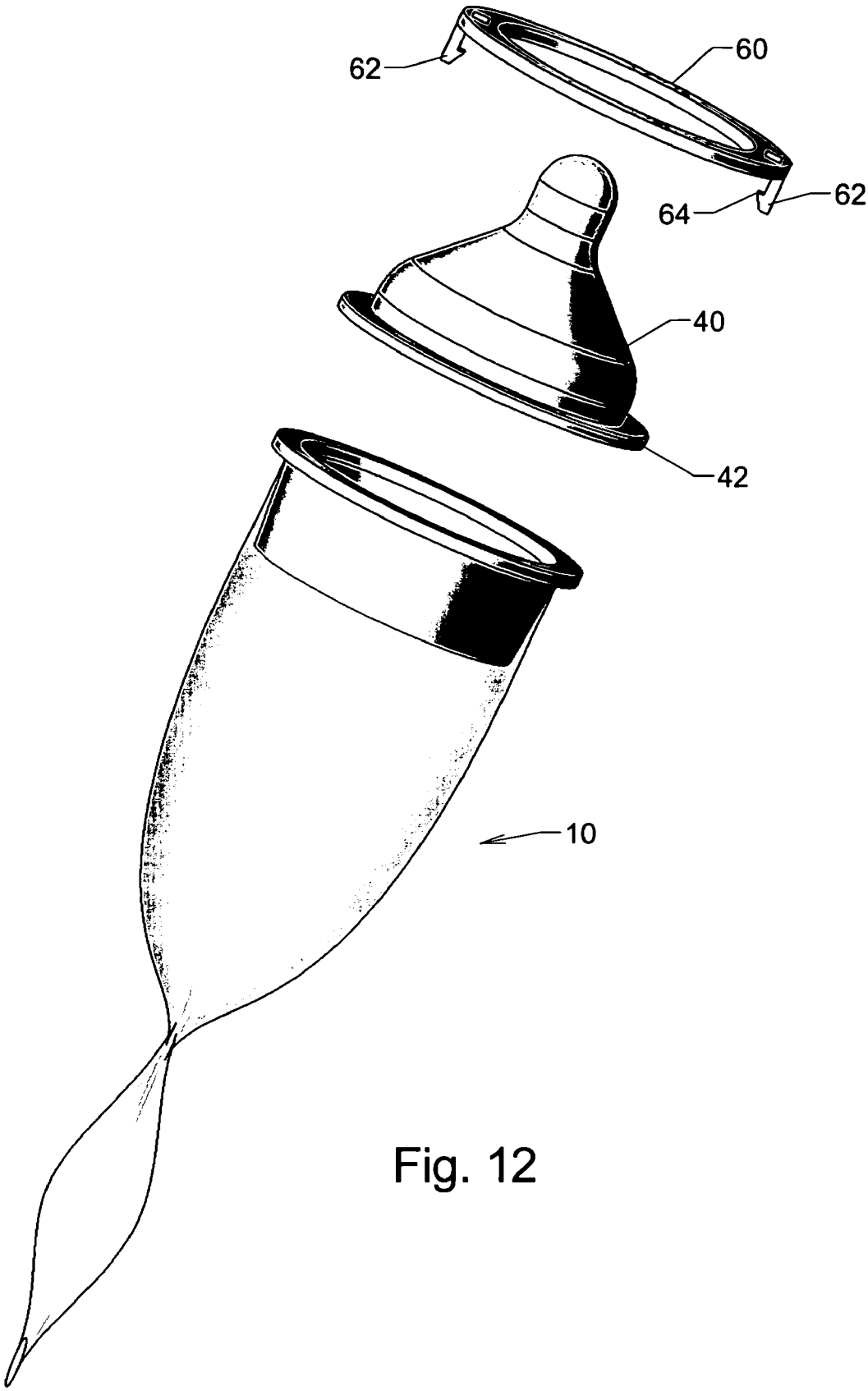
FIG. 12 is an exploded view of the beverage dispenser of the present invention with a nipple and a compression ring, the ring having two fingers.
Figure 13:
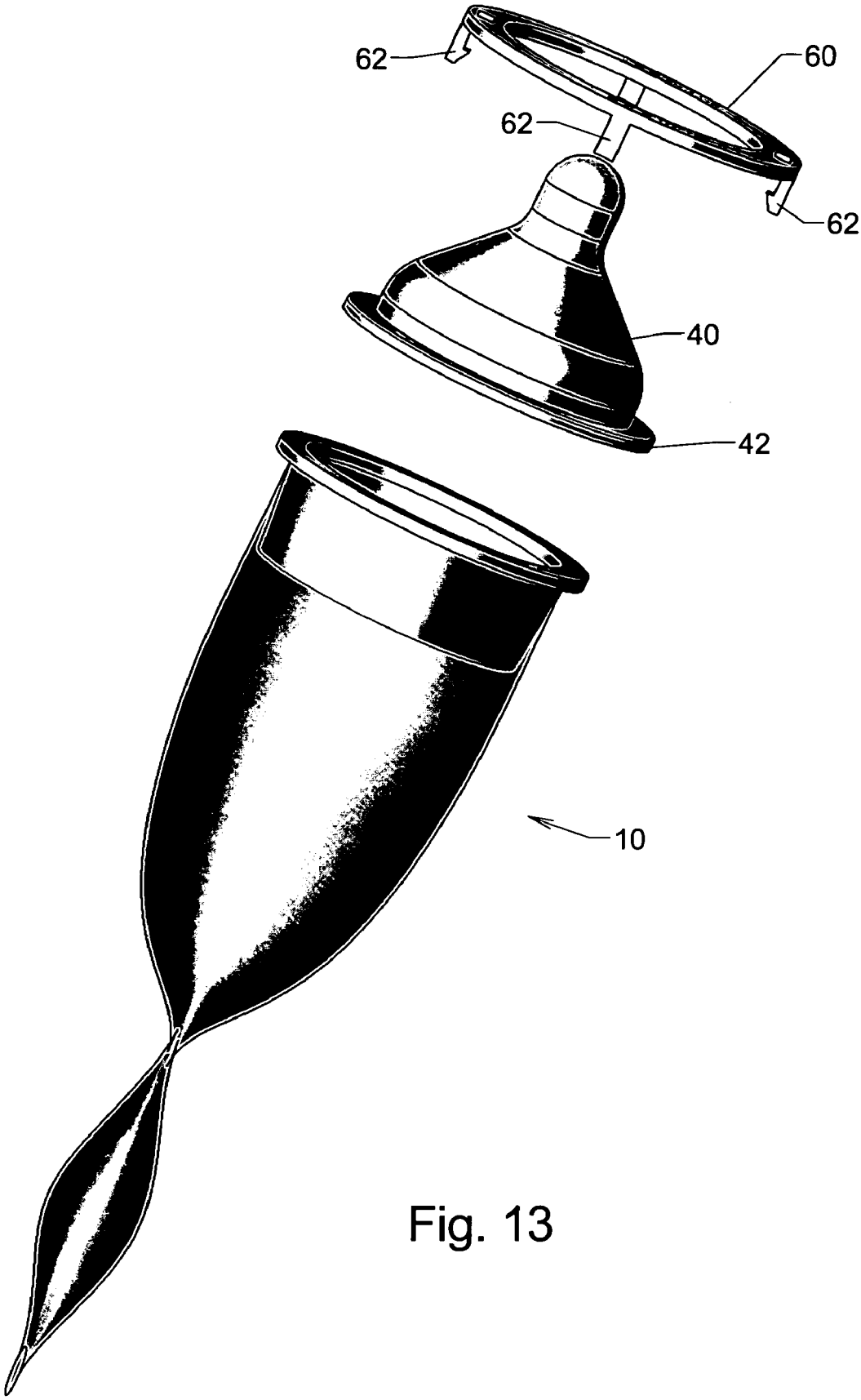
FIG. 13 is an exploded view of the beverage dispenser of the present invention with a nipple and a compression ring, the ring having four fingers.

FIG. 12 and FIG. 13 illustrate the embodiment where a bottle is not used. In this embodiment of the present invention, a nipple 40 and a compression ring 60 is used with the beverage dispenser 10 of the present invention. The compression ring 60 in FIG. 12 has two fingers 62 with tips 64 on each finger that when the ring 60 is pushed over the lower rim 42 of nipple 40 and the upper portion 16 of connector 12 compresses and seals the nipple 40 on the beverage dispenser 10 when the tips 64 seat on the lower surface 17 of upper portion 16 of connector 12.

The invention claimed is:

1. A beverage dispenser comprising:

a solid connector, said connector having an upper portion shaped as a washer, said washer being a thin, flat ring with an opening in the center, and a lower portion having on outer surface that is of lesser diameter than said washer outer surface and is several magnitudes thicker than said washer portion but having a center opening through said lower portion that is the same as the center opening in said washer portion; and a plastic bag connected to said lower portion of said connector, wherein said bag has two compartments, one compartment adapted to contain a solid, and one compartment adapted to contain a liquid; and a heat sealed seam which is easily rupturable separating said compartments.

2. A beverage dispenser according to claim 1-which further includes a cover that seals the top surface of said solid connecter.

3. A beverage dispenser according to claim 2 wherein said cover is a filmed sheet with a tab.

4. An infant formula beverage dispenser comprising:

a solid connector, said connector having an upper portion shaped as a washer, said washer being a thin, flat ring with an opening in the center, and a lower portion having on outer surface that is of lesser diameter than said washer outer surface and is several magnitudes thicker than said washer portion but having a center opening through said lower portion that is the same as the center opening in said washer portion; and a plastic bag connected to said lower portion of said connector, wherein said bag has two compartments, one compartment adapted to contain a solid, and one compartment adapted to contain a liquid; and a heat sealed seam which is easily rupturable separating said compartments; and a baby bottle, said bottle terminating at the top with a lip and having threads on the outer surface at the top of said bottle;

said solid connecter and bag adapted to be inserted into said bottle such that the lower surface of the washer portion of said connecter rests on said lip of said bottle.

5. An infant formula beverage dispenser according to claim 4 which further includes a cap that is adapted to be threaded to the threads on said bottle.

6. An infant formula beverage dispenser according to claim 5 wherein said cap includes a nipple.

7. A disposable infant formula beverage dispenser comprising:

a solid connector, said connector having an upper portion shaped as a washer, said washer being a thin, flat ring with an opening in the center, and a lower portion having on outer surface that is of lesser diameter than said washer outer surface and is several magnitudes thicker than said washer portion but having a center opening through said lower portion that is the same as the center opening in said washer portion; and a plastic bag connected to said lower portion of said connector, wherein said bag has two compartments, one compartment adapted to contain a solid, and one compartment adapted to contain a liquid; and a heat sealed seam which is easily rupturable separating said compartments;

a nipple; and a snap ring, said ring having a outside diameter essentially the same as the diameter of the upper surface of the washer portion of said connecter and the lower surface of said nipple, to hold said lower surface of the nipple to the upper surface of the washer portion of said connecter.

* * * * *